US008834722B2

(12) United States Patent
Sjong

(10) Patent No.: US 8,834,722 B2
(45) **Date of Patent: *Sep. 16, 2014**

(54) MAGNETIC IN-LINE PURIFICATION OF FLUID

(75) Inventor: Angele Sjong, Louisville, CO (US)

(73) Assignee: Empire Technology Development LLC, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/466,868

(22) Filed: May 8, 2012

(65) Prior Publication Data

US 2012/0217204 A1 Aug. 30, 2012

Related U.S. Application Data

(63) Continuation of application No. 13/121,175, filed as application No. PCT/US2010/061575 on Dec. 21, 2010, now Pat. No. 8,192,630.

(51) Int. Cl.

| | |
|---|---|
| ***B03C 1/01*** | (2006.01) |
| ***B03C 1/30*** | (2006.01) |
| ***B01F 3/08*** | (2006.01) |
| ***B01F 13/08*** | (2006.01) |
| ***B01F 13/00*** | (2006.01) |
| ***B03C 1/28*** | (2006.01) |

(52) U.S. Cl.

CPC ..... *B01F 13/0059* (2013.01); *B03C 1/01* (2013.01); *B01F 13/0809* (2013.01); *B01F 3/0815* (2013.01); *B01F 13/0006* (2013.01); *B03C 2201/32* (2013.01); *B03C 1/30* (2013.01); *B03C 1/288* (2013.01)

USPC ..... 210/695; 210/749; 436/177; 436/526

(58) Field of Classification Search

CPC ..... B03C 1/01; B03C 1/32; B03C 1/288; B03C 2201/32; B03C 1/30; B01F 3/083; B01F 3/0815

USPC ..... 436/177, 526; 252/62.51 R, 62.56; 210/695, 222, 749

See application file for complete search history.

(56) References Cited

U.S. PATENT DOCUMENTS

| | | | |
|---|---|---|---|
| 3,700,595 | A | 10/1972 | Kaiser |
| 5,772,877 | A | 6/1998 | Dvorchik et al. |
| 6,013,188 | A | 1/2000 | Terstappen et al. |
| 2010/0116747 | A1 | 5/2010 | Franzreb et al. |

OTHER PUBLICATIONS

Carazzo et al., Dynamic Surface Tension Measurement of Water Surfactant Solutions, *J. Chem. Eng. Data.* (Jul. 6, 2009), 54(11):3092-3095.

Chastek et al., A microfluidic platform for integrated synthesis and dynamic light scattering measurement of block copolymer micelles, *Lab Chip* (May 1, 2008), 8(6):950-957.

International Search Report and Written Opinion for International Application PCT/US2010/061575, mailed Mar. 7, 2011.

Emulsion Polymerization, Wikipedia, http://en.wikipedia.org/wiki/Emulsion_polymerization.

(Continued)

*Primary Examiner* — David A Reifsnyder

(74) *Attorney, Agent, or Firm* — Pepper Hamilton LLP

(57) ABSTRACT

Methods for in-line purification of surfactant from a first fluid, such as a microemulsion are disclosed. Magnetic particles coated with surfactant molecules may be used to bind surfactants from a fluid. A magnetic field may be used to separate the bound materials from the fluid.

16 Claims, 6 Drawing Sheets

(56) References Cited

OTHER PUBLICATIONS

Ferrofluid, Wikipedia, http://en.wikipedia.org/wiki/Ferrofluid.
Mills, P. et al, Microreactor technology and process miniaturization for catalytic reactions—A perspective on recent developments and emerging technologies, Chemical Engineering Science, 62, (2007), 6992-7010.
Pavel, F., Microemulsion Polymerization, J. Dispersion Science and Technology, vol. 25, No. 1, p. 1-16, 2004.
Guyot, A. et al., Reactive Surfactants in Emulsion Polymerization, Book Chapter, Polymer Synthesis, ISBN 978-3-540-57198-8, vol. 111, 1994.
Non-Final Office Action for U.S. Appl. No. 13/121,175, mailed Nov. 1, 2011 (8 pgs).
Notice of Allowance for U.S. Appl. No. 13/121,175, mailed Feb. 14, 2012 (6 pgs).

Computer program product 601

Signal-bearing medium 603

Instructions 605

Cause a computing device to generate signals to operate a microreactor to:

- Flow a first fluid through a first channel of the microreactor.
- Combine a first fluid with a second fluid from a second channel of the microreactor to form a mixture in a mixing area of the microreactor.
- Pass a mixture through a third channel coupled to a mixing area, wherein the third channel comprises a magnetic channel section.
- Selectively activate an agitator of the microreactor.
- Selectively activate one or more wire coils situated proximally to a magnetic channel section to generate a magnetic field.

Fig. 6

MAGNETIC IN-LINE PURIFICATION OF FLUID

CROSS-REFERENCE TO RELATED APPLICATION

The present application is a continuation of and claims priority to U.S. patent application Ser. No. 13/121,175, filed Mar. 25, 2011, and entitled "MAGNETIC IN-LINE PURIFICATION OF FLUID," which is a 35 USC 371 national phase entry application of PCT/US2010/061575, filed Dec. 21, 2010, the entire disclosures of which are hereby incorporated by reference in its entirety.

BACKGROUND

Surfactants are used in many chemical reactions, such as for example emulsion polymerization reactions. Emulsion polymerization takes place in a heterogeneous solution which is most often an oil-in-water solution but may also be a water-in-oil solution, or other emulsion type. A monomer (such as for example styrene or methyl methacrylate), a surfactant, and a free radical initiator are added to the emulsion. Polymerization of the monomers occurs within micelles formed by the surfactant and is aided by the free radical initiator molecules.

Microemulsion polymerization forms nano-sized polymer particles. Microemulsions have certain desirable characteristics such as the forming of optically clear colloids and the capability of forming small-sized polymers that can be engineered with a wide range of properties.

Microemulsion polymerization requires a significant amount of surfactant (for example 10% of the total mass) to stabilize the interfacial area. But a high level of surfactant can affect properties of the microemulsion and/or have an affect on biological activity. This can be a problem for example when the microemulsion polymerization product is intended for medical applications.

Microreactors are often used for conducting microemulsion polymerization. The high surface-to-volume ratio of microchannels within microreactors produces dominant surface tension forces which may be advantageous when forming certain microemulsions. Microreactors generally include a network of microchannels (for example micron-sized channels). Chemical agents can be brought together via various microchannels and allowed to react in one or more controlled regions of the microreactor. The sequence of reactions can be controlled so as to produce the desired final product. Electrokinetically driven microreactors employ electrodes placed in reservoirs. Voltages can be applied to the electrodes in a specific sequence, often under computer control, to cause the flow of polar liquids using electric fields to bring the reagents together in a desired fashion. Microreactors may also be hydrodynamically driven. Hydrodynamic pumps may be conventional or micro-scale pumps—such as syringe-type pumps—that are either external to the microreactor, or which have small moving parts inside the microreactor.

A ferrofluid is a liquid which becomes strongly polarized in the presence of a magnetic field. A ferrofluid is a magnetic fluid comprised of magnetic particles—in particular nanoparticles—coated with a surfactant and suspended in water or an organic solvent. A ferrofluid is a colloid. The magnetic particles are usually magnetite, which are solid ferrous (iron-based) compounds.

SUMMARY

The foregoing summary is illustrative only and is not intended to be in any way limiting. In addition to the illustrative aspects, embodiments, and features described above, further aspects, embodiments, and features will become apparent by reference to the drawings and the following detailed description.

The present disclosure describes a method. Some example methods include providing a first fluid having a plurality of first surfactant molecules and providing a second fluid comprising magnetic particles coated with a plurality of second surfactant molecules. In example methods, the second surfactant molecules are or have been selected to associate with the first surfactant molecules. The example methods include contacting the first fluid and the second fluid to form a mixture containing bound surfactant particles, and then passing the mixture through a magnetic channel to separate the bound surfactant particles from the mixture.

In example methods, the first fluid comprises an emulsion containing polymeric particles in micelles. In example methods, the first fluid is a latex formed by a microemulsion polymerization reaction. In example methods, the second fluid is a ferrofluid.

Example methods also include collecting the mixture after the mixture has passed through the magnetic channel section. The magnetic channel section is a section of a microchannel of a microreactor. Example magnetic channel sections comprise one or more magnets exterior to the microchannel. Example magnetic sections comprise one or more wire coils coupled to a selectable voltage source, and exemplary methods according to the present disclosure further comprise selecting a voltage with the selectable voltage source.

The present disclosure also describes an apparatus for in-line purification. Example apparatuses comprise a first channel configured to receive a first fluid, a second channel configured to receive a second fluid, and a mixing area situated at an intersection of the first channel and the second channel. Example apparatuses include a third channel configured to receive a mixture of the first fluid and the second fluid from the mixing area. The third channel comprises a magnetic section.

Example apparatuses also comprise an agitator situated along the third channel between the mixing area and the magnetic section. Example magnetic sections comprise one or more magnets exterior to the magnetic section. Example magnetic sections comprise one or more wire coils coupled to a selectable voltage source. Example apparatuses comprise one or more pumps.

The present disclosure describes a system for in-line purification. Example systems comprise a microreactor having a plurality of pumps and a control device operatively coupled to the microreactor and configured to selectively activate individual ones of the plurality of pumps to operate the microreactor to flow a first fluid through a first channel of the microreactor. The first fluid includes a plurality of first surfactant molecules. The control devices of example systems are also configured to selectively activate individual ones of the plurality of pumps to operate the microreactor to combine the first fluid with a second fluid from a second channel of the microreactor to form a mixture in a mixing area of the microreactor. The mixing area is situated at an intersection of the first channel and the second channel. The second fluid comprises magnetic particles coated with a plurality of second surfactant molecules, and the first surfactant molecules are attractive to the second surfactant molecules. The control devices of example systems are also configured to selectively activate individual ones of the plurality of pumps to operate the microreactor to pass the mixture through a third channel coupled to the mixing area to separate the first surfactant molecules from the mixture. The third channel comprises a magnetic channel section.

Example systems also include microreactors with an agitator situated along the third channel between the mixing area and the magnetic channel section. The control device is further configured to selectively activate the agitator.

Example systems also include microreactors with one or more wire coils situated along the magnetic channel section. The control device is further configured to selectively activate the one or more wire coils to generate a magnetic field. Example systems also include microreactors with or more magnets exterior to the magnetic channel section.

Embodiments of the present disclosure include computer-readable media having instructions stored thereon that, in response to execution by a computing device coupled to a microreactor having a plurality of pumps, cause the computing device to generate signals to operate the microreactor to perform various functions. Example functions include flow a first fluid through a first channel of the microreactor. The first fluid includes a plurality of first surfactant molecule. Example functions also include combine the first fluid with a second fluid from a second channel of the microreactor to form a mixture in a mixing area of the microreactor. The mixing area is situated at an intersection of the first channel and the second channel, the second fluid comprises magnetic particles coated with a plurality of second surfactant molecules, and the first surfactant molecules are attractive to the second surfactant molecules. Example functions also include pass the mixture through a third channel coupled to the mixing area to separate the first surfactant molecules from the mixture. The third channel comprises a magnetic channel section.

Example instructions, in response to execution by the computing device, cause the computing device to generate signals to selectively activate an agitator of the microreactor. Example instructions, in response to execution by the computing device, cause the computing device to generate signals to selectively activate one or more wire coils situated proximally to the magnetic channel section to generate a magnetic field.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

FIG. 6 illustrates a computer program product; all arranged in accordance with the present disclosure.

DETAILED DESCRIPTION OF EMBODIMENTS

Figure 1:
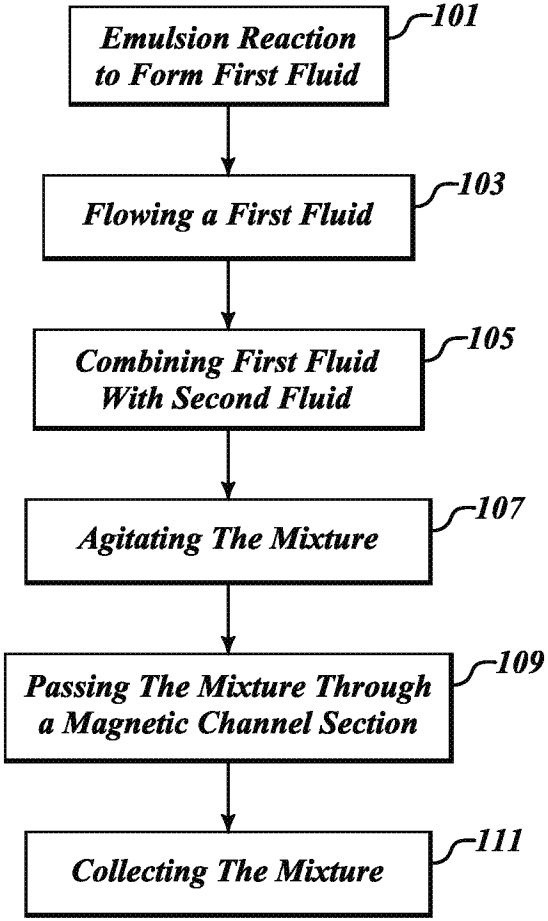
FIG. 1 illustrates a method for in-line purification using a magnet.

The following description sets forth various examples along with specific details to provide a thorough understanding of claimed subject matter. It will be understood by those skilled in the art, however, that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

This disclosure is drawn to methods, apparatuses, microreactors, and systems for in-line purification of reaction mixtures (for example, the removal of surfactants from reaction mixtures). A first fluid having a first surfactant is provided, and a second fluid having magnetic particles coated with a second surfactant is provided. The first fluid is contacted or combined with the second fluid to form a mixture. Attraction between the first surfactant molecules and the second surfactant molecules cause the first surfactant molecules to bind to the coated magnetic particles forming bound surfactant particles. The mixture is exposed to a magnetic field, such as that encountered when passed through a magnetic channel, such as a channel section of a microreactor. The magnetic field may attract the magnetic particles, along with the bound first surfactant, to the channel walls thereby removing the first surfactant from the mixture. An attractive feature of the disclosed methods, apparatuses, and systems is that separation of the first surfactant from the mixture may be accomplished without diluting the mixture.

A first fluid may be prepared after performing a chemical reaction. The type of chemical reaction can generally be any type of chemical reaction. The first fluid may include a surfactant. The first fluid will typically also contain a desired material which one wishes to separate from the first surfactant. This first fluid may be the product of the emulsion polymerization reaction. The first fluid may be a polymer microemulsion (e.g., a desired latex material) having micelles formed by a first surfactant (e.g., an emulsion surfactant). Selection of the surfactant may be important to the development of an emulsion polymerization process. A surfactant may be selected based on polymerization rate, the surfactant's potential for minimizing coagulum or fouling of the reactor and other process equipment, the surfactant's viscosity during polymerization, and potential for desirable properties in the end-product such as tensile strength, gloss, and water absorption. Anionic, nonionic, and cationic surfactants may be used. Surfactants with a low critical micelle concentration (CMC) are typically favored for emulsion polymerization. Mixtures of surfactants are often used, including mixtures of anionic surfactants and nonionic surfactants.

Examples of surfactants commonly used in emulsion polymerization include fatty acids, sodium lauryl sulfate, and alpha olefin sulfonate. Desired polymeric particles may form within the micelles during the emulsion polymerization reaction. The first fluid having the first (emulsion) surfactant may be contacted with a second fluid having magnetic particles coated by a second surfactant to form a mixture. The second fluid may be, but is not limited to, a ferrofluid. A ferrofluid may be selected based on whether the emulsion polymerization reaction was oil-in-water (where water is the carrier solvent), or water-in-oil. For oil-in-water, a water-based ferrofluid may be desired and the second surfactant may be, but is not limited to, cis-oleic acid, citric acid, or soy lecithin. Tetra-methylammonium hydroxide may be used in a water-based ferrofluid. Other water-based ferrofluids may include alginate-based ferrofluids. Ferrofluids may be readily prepared (such as starting from common materials such as magnetite, iron (III) chloride, or iron oxide) or are commercially available from a variety of sources such as Ferrotec Corporation and United Nuclear Scientific LLC.

The concentration of ferrous particles to ferrofluid surfactant (molar ratio) may generally be any concentration, with examples being in the range of about 1/0.3 to about 1/6. In mass, the typical ferrofluid is about 5% magnetic solid and about 10% surfactant, but other percentages may be used. This ratio of particles to ferrofluid surfactant may be varied depending on how much surfactant surrounds the particle, and that in turn depends on such factors as how small the ferrous particles are and the surfactant packing density around the particle. The ratio between ferrofluid surfactant and emulsion surfactant could be about one-to-one if there is a sufficiently strong attraction between the two surfactants. How the emulsion surfactant packs around the ferrofluid surfactant may depend on the level of attraction between the two surfactants, and the ability of the emulsion surfactant to pack in that geometry. Molar ratios between the ferrofluid surfactant and the emulsion surfactant may be, in embodiments, a one-to-one; in other embodiments the ratio may be between about 10:1 and about 1:10, depending on the factors discussed above. A skilled artisan can readily use routine optimization experiments to optimize the various concentrations and ratios to fit a particular combination of particles and surfactants.

Emulsion surfactants according to embodiments may be, for example, the Tergitol™ series surfactants from the Dow Chemical Company and Dowfax™ 8390 from the Dow Chemical Company. Examples of anionic surfactants may include Alkyl Benzene Sulphonate Derivatives: NANSA® series; Alpha Olefin Sulphonates: NANSA® LSS series; Alcohol Sulphates: EMPICOL® series; Alcohol Ethoxy Sulphates: ALKANATE W®, EMPICOL® series; Alkylphenol Ethoxy Sulphates: ALKANATE® W, EMPICOL® series; Naphthalene Sulphonate Derivatives: DEHSCOFIX® series; Sulphosuccinates: EMPICOL® S, SURFONIC® DOS series; Phosphate Ester Derivatives: ALKANATE® P, EMPIPHOS, and SURFONIC® PE series. Example nonionic surfactants may include Alkylphenol Alkoxylates: EMPILAN® NP, EMPILAN® OP, SURFONIC® N, SURFONIC® OP, TERIC® N, TERIC® X series; Alcohol Alkoxylates: EMPILAN® K, SURFONIC® L, TERIC® A series; EO/PO Copolymers: EMPILAN® PF, SURFONIC® POA, TERIC® PE series; Alkyl Polysaccharides: ALKADET®, ECOTERIC® series; Alkylamine Ethoxylates: EMPILAN® AMO, EMPILAN® AMT, SURFONIC® T, and TERIC® M series. Example cationic surfactants include dodecyltrimethylammonium bromide (DTAB) and hexadecyltrimethylammonium bromide (HDTAB).

When the first surfactant and second surfactant contact each other, the attraction causes the first surfactant to become bound to the coated magnetic particles. In some cases, the first surfactant is present in the form of a micelle. In some cases, binding of the first surfactant may cause disruption of the micelle structure. As a mixture passes through a magnetic channel (such as, for a non-limiting example, a microchannel of a microreactor), the magnet may attract the coated magnetic particles, as well as the bound first surfactant, to the channel walls. Polymeric particles in the mixture, such as free polymeric particles or polymeric particles that were previously in micelles from an emulsion polymerization mixture, may be completely or mostly non-magnetic and may pass through the channel with the help of a carrier fluid of the first and/or second fluid (e.g., oil, water, or a carrier solvent). In this way, the first (emulsion) surfactant may be removed partly or completely from the mixture. In an oil-in-water emulsion, a cationic surfactant may be used to coat the magnetic particle. The cationic surfactant may interact with a negatively charged surfactant used in oil-in-water emulsion polymerization reactions.

Various embodiments are not limited to in-line purification of emulsion polymerization surfactants. For example, surfactants are also used as foaming agents for creating fine powders. Such foaming agents may be, for example QUIKFOAM® surfactant foaming agent.

FIG. 1 illustrates a method for in-line purification using a magnet. An emulsion reaction, such as but not limited to a microemulsion polymerization reaction, may be carried out, block 101. The microemulsion polymerization reaction may be carried out in a microreactor, or in some other reactor type such as but not limited to batch, semi-batch, continuous, microwave reactor, tubular reactor. The microemulsion polymerization reaction may result in a latex mixture, having polymeric particles contained within micelles formed by an emulsion surfactant suspended in a carrier fluid. The reaction product—a first fluid—may flow through a channel, block 103. A second fluid may be contacted and combined with the first fluid to form a mixture, block 105. The second fluid may comprise suspended magnetic particles coated with a second surfactant. The second fluid may be a ferrofluid, and the magnetic particles may be micro-sized magnetite particles. Magnetic particles may be nano-sized. Magnetic particles may generally be any size and shape, regular or irregular, and typically are spherical. The mixture of the first fluid and the second fluid may be agitated, block 107. At least partially as a result of agitating the mixture, molecules of the first surfactant type may become bound to the coated magnetic particles.

The mixture may be passed through a magnetic channel of a reactor, such as a microchannel of a microreactor, block 109. Embodiments are not limited to microreactors. A purified mixture may be collected (such as for example a fine powder or after the mixture has passed through the magnetic section of the channel, block 111. The purified mixture may have some or ideally all of the first surfactant (as well as the second surfactant type) separated. The magnet may subsequently be removed, and the magnetic channel flushed to remove the magnetic particles. Once the particles have been removed, they may be recycled for re-use. In embodiments using batch or semi-batch processes, the magnetic particles may be removed prior to running a subsequent batch.

Figure 2:
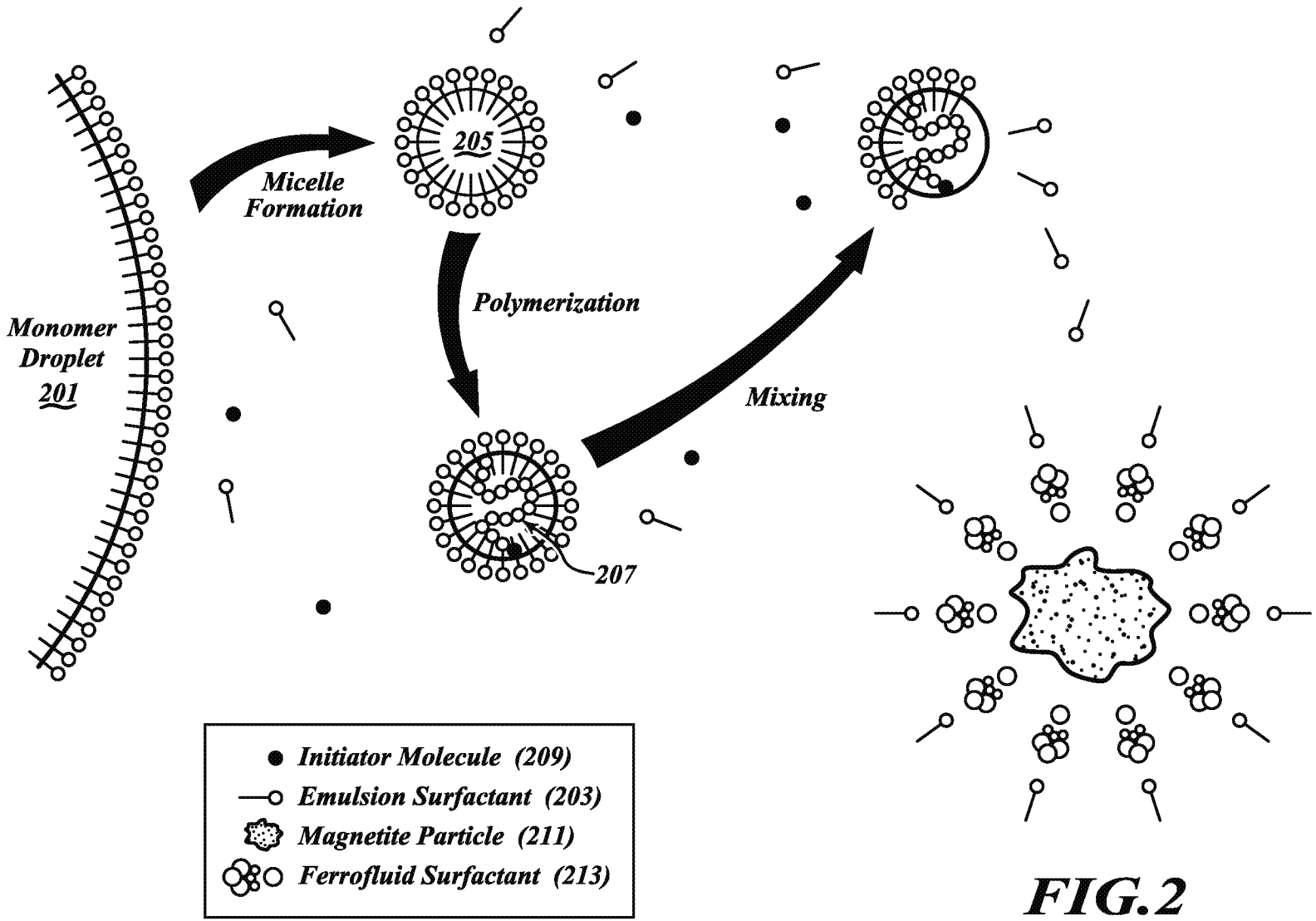
FIG. 2 illustrates the formation of polymeric particles within a microemulsion and the attraction of emulsion surfactant to a ferrofluid.

FIG. 2 illustrates the formation of polymeric particles within a microemulsion and the attraction of the emulsion surfactant to a ferrofluid. Monomer droplet 201 may comprise monomer particles (such as but not limited to styrene or methyl methacrylate) with emulsion surfactant molecules 203 at the boundary between monomer droplet 201 and a carrier fluid. For example, this may be an oil-in-water emulsion, having a water-based carrier fluid and an oil monomer bounded by emulsion surfactant 203. Micelles, such as micelle 205, may be formed within the carrier fluid. The micelle may comprise a quantity of monomer molecules. Polymerization may occur within micelle 205 as is shown in FIG. 2. For example, polymeric particle 207 may be formed within micelle 205, aided by an initiator molecule 209. Extra emulsion surfactant molecules 203 and unbound initiator molecules 209 may also be present within the carrier fluid. Selecting the micelle size may be part of the emulsion polymerization process. Some processes may require very fine polymer particles, and may therefore use very small micelles, while other processes may use larger micelles to produce large polymer particles. As an example, microreactors may be desirable for the very small particle size that can be achieved, which uses high surfactant loadings.

At a mixing stage, a second fluid—such as a ferrofluid—may be contacted with the microemulsion to form a mixture. The second fluid may comprise magnetite particles 211 coated with molecules of a second (ferrofluid) surfactant 213. The mixture may optionally be agitated to accelerate mixing of the various materials. The emulsion surfactant molecules 203 may be attracted to ferrofluid surfactant molecules 213 as is depicted in the bottom-right portion of FIG. 2. This attraction may disrupt micelles 205, and free polymeric particles 207 that were previously inside the micelles.

The mixture may then be passed through a magnetic channel section of a microreactor to attract the magnetite particles 211, along with bound emulsion surfactant 203, to the channel walls. Such a microreactor may be adapted not only for in-line purification, but also for promoting the polymerization reaction, such as by introducing emulsion surfactant 203 and initiator molecules 209 to a suspension of the monomer in the carrier fluid. A microreactor for in-line purification according to embodiments will now be described.

Figure 3:
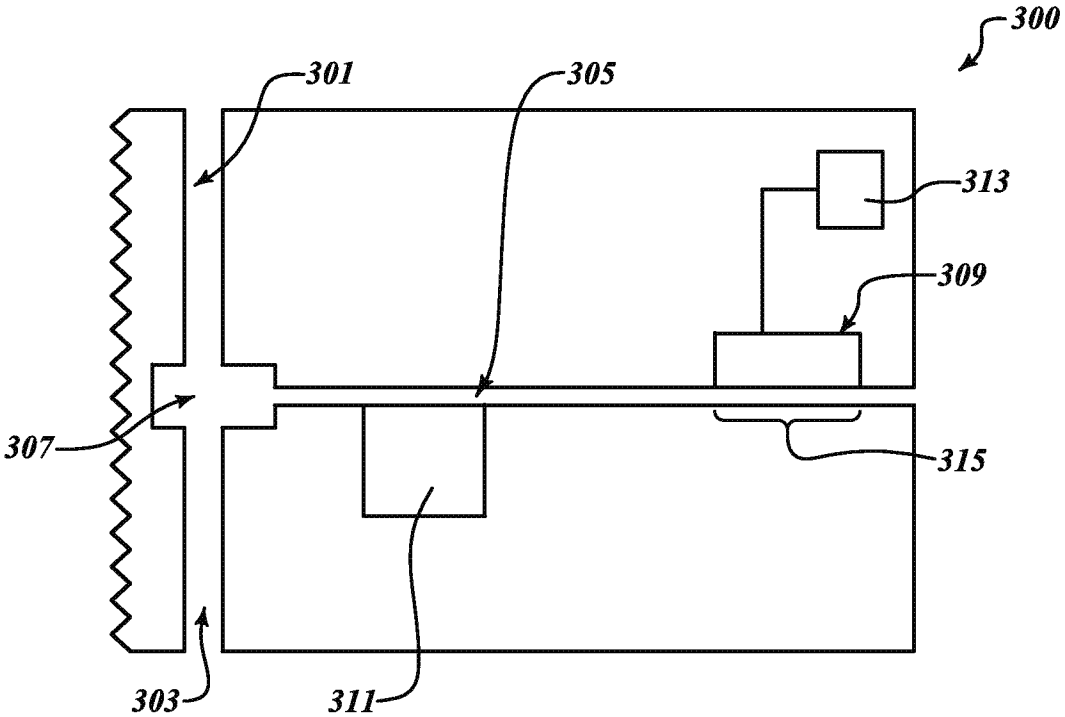
FIG. 3 illustrates a microreactor section for in-line purification using a magnet.

FIG. 3 illustrates a microreactor section for in-line purification using a magnet. Microreactor portion 300 may include first channel 301 adapted to receive a first fluid, such as a microemulsion, and a second channel 303 adapted to receive a second fluid, such as a ferrofluid. Various pumps (not shown in the Figure)—electrokinetic or hydrodynamic, among others—may be situated at various locations along at least one of first channel 301, second channel 303, and third channel 305 to cause flow of fluids. Such internal pumps may be adapted to be selectively activated by an external or internal control device (not shown in the Figure). In other embodiments, external pumps (for example syringe-type pumps or other types) may be used to cause a flow of fluids through first channel 301 and/or second channel 303.

Whether internal or external pumps are used, flow of the first and second fluids may be directed along their respective channels toward mixing area 307. Mixing area 307 may be situated at the confluence or intersection of first channel 301 and second channel 303. Third channel 305 may be adapted to receive a mixture of the first fluid and the second fluid from mixing area 307. Third channel 305 may comprise magnetic section 315 having a magnet 309. Microreactor portion 300 may further comprise agitator 311 situated along third channel 305 between the mixing area 307 and magnet 309. Agitator 311 may be adapted to cause agitation of the mixture as the mixture passes through third channel 305. Agitator 311 may be a separate component of microreactor portion 300 or may be an area of third channel 305 where flow rate and channel geometry are controlled to agitate the mixture. In embodiments not shown in FIG. 3, there may be another agitator in mixing area 307; such an agitator may be used instead of a separate agitator 311. In various other embodiments (not shown), mixing area 307 and agitator 311 may be combined into a single area or location.

In some configurations, magnet 309 may be exterior to magnetic section 315 such as affixed to the exterior of magnetic section 315. Magnet 309 may be composed of any magnet material such as magnetite, lodestone, cobalt, nickel, gadolinium, dysprosium, or one of various composites such as alnico, ticonal, vinyl composites, or injection-molded magnets. Magnet 309 may be, in some configurations, a coating of magnetic metal, or composite (such as those listed above) on an area of the microreactor portion 300 or, in other configurations, an internal section of third channel 305. In alternate configurations, the magnetic section may comprise one or more electromagnets composed of one or more wire coils surrounding an iron or ferrous coil coupled to selectable voltage source 313. Such wire coils may be composed of, for example, copper, gold, silver, aluminum, or other metals. Selectable voltage source 313 may be selectively activated to cause electric current to flow through such a wire coil to cause a magnetic field within magnetic section 315. In various other configurations not shown in FIG. 3, a magnet external to microreactor portion 300 may be employed. The magnetic field could be a pulsed magnetic field, or may otherwise vary with time. Such may be useful for controlling ferrofluid movement in channels.

In various configurations, microreactor 300 may comprise a polymerization reactor (not shown) adapted to produce the first fluid. A system that combines a polymerization reactor and an in-line purification reactor will now be described.

Figure 4:
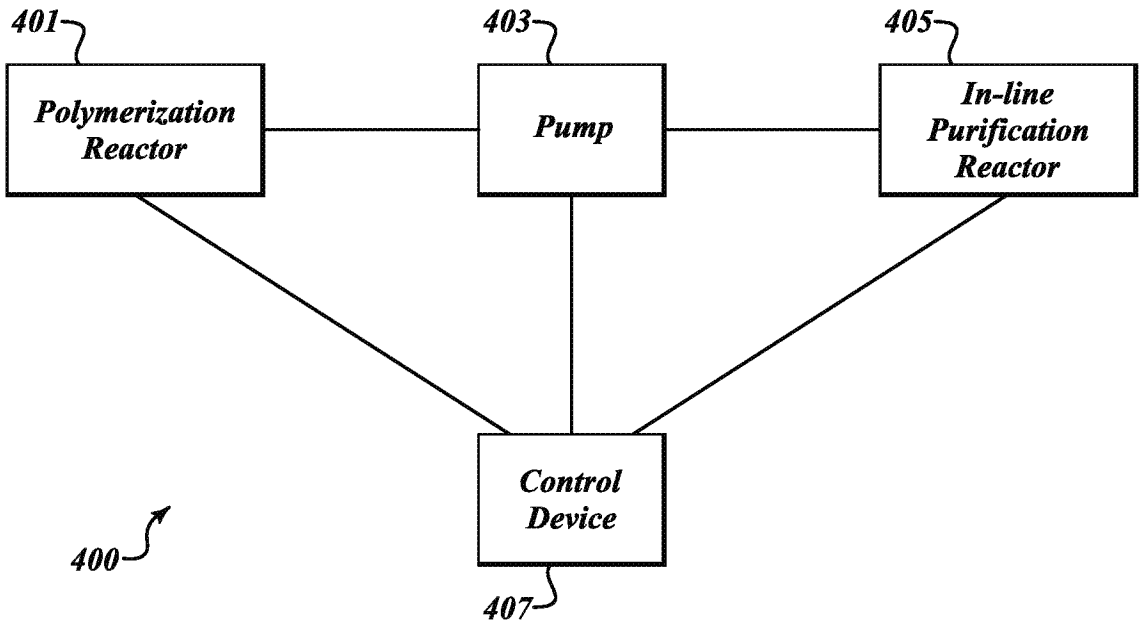
FIG. 4 illustrates a block diagram of a system for in-line purification including a control device.

FIG. 4 illustrates a block diagram of a system for in-line purification including a control device. Purification system 400 may include polymerization reactor 401. Polymerization reactor 401 may be a microreactor or other reactor type such as but not limited to batch, semi-batch, continuous, microwave reactor, or tubular reactor. The product of polymerization reactor 401 may be a microemulsion comprising, among other things, an emulsion surfactant and polymeric particles. Pump 403 may be adapted to introduce the microemulsion product into in-line purification reactor 405. Pump 403 may be electrokinetic, hydrodynamic, or another pump type. Pump 403 may be external to polymerization reactor 401 and/or in-line purification reactor 405. In various configurations, polymerization reactor 401, pump 403, and in-line purification reactor 405 may comprise a single reactor, such as a microreactor. In various configurations, polymerization reactor 401 and/or in-line purification reactor 405 may have one or more internal pumps.

Control device 407 may be configured to cause a flow of a first fluid—the product of polymerization reactor 401—through a first channel of the in-line purification reactor 405 via control of pump 403 or other internal or external pumps (not shown in the Figure). Control device 407 may be configured to combine a second fluid from a second channel of in-line purification reactor 405 to the first fluid to form a mixture in a mixing area of in-line purification reactor 405. The second fluid may comprise magnetic particles each coated with a plurality of second surfactant molecules. The second fluid may be a colloid. Control device 407 may be further adapted to cause the mixture to pass through a third channel of in-line purification reactor 405 that comprises a magnetic channel section. The magnetic particles may be attracted by the magnetic field of the magnetic channel section and adhere to the side of the magnetic channel section as the mixture passes through the third channel. Polymeric particles within the mixture may pass through the magnetic section and emerge from in-line purification reactor 405 in a carrier fluid that has all or some of an emulsion surfactant removed.

In-line purification reactor 405 may comprise an agitator situated along the third channel between the intersection of the first and second channels and the magnetic channel section. Control device 407 may be adapted to selectively activate the agitator, such as by activating various electrokinetic pumps to control flow rate. Agitation of the mixture as it passes by the agitator may aid in the bonding of the emulsion surfactant to the coated magnetic particles. In some configurations, the magnetic section of the third channel may comprise one or more wire coils situated proximally to the magnetic channel section. Control device 407 may be configured to selectively activate the one or more wire coils to generate the magnetic field. In alternate configurations, the magnetic section may comprise one or more permanent or semi-permanent magnets located on an exterior of the magnetic channel section.

Control device 407 may be, according to various configurations, a computing system, a field programmable gate array, an application-specific integrated circuit, or other component types. An example computing system will now be described. Control device 407 may be configured to release the bound magnetic particles, such as by turning off a magnet in in-line purification reactor 405. Also, control device 407 may be configured to indirectly detect sufficient micelle breakdown and surfactant removal. A light-scatter or dynamic contact angle measurement could be used within the reactor to detect the presence of micelles in the reactor, as is described for example in "Dynamic Surface Tension Measurement of Water Surfactant Solutions", Daniele Carazzo, Arnold Wohlfeil, and Felix Ziegler, J. Chem. Eng. Data 2009, 54, 3092-3095, and "A microfluidic platform for integrated synthesis and dynamic light scattering measurement of block copolymer micelles," Thomas Q. Chastek, Kazunori Iida, Eric J. Amis, Michael J. Fasolka, Kathryn L. Beers, Lab Chip, 2008, (6), 950-957. Control device 407 may be configured to perform a recirculation of the mixture through one or more portions of in-line purification reactor 405. Control device 407 may be configured to select surfactant for the emulsion reaction, such as for example by directing selected surfactants towards a mixing area of in-line purification reactor 405. In such configurations, multiple emulsion surfactants may be available to the microreactor, and the desired emulsion surfactant may be selected. Control device 407 may be configured to control an intensity of agitation, such as for example by controlling flow rate through in-line purification reactor 405.

Figure 5:
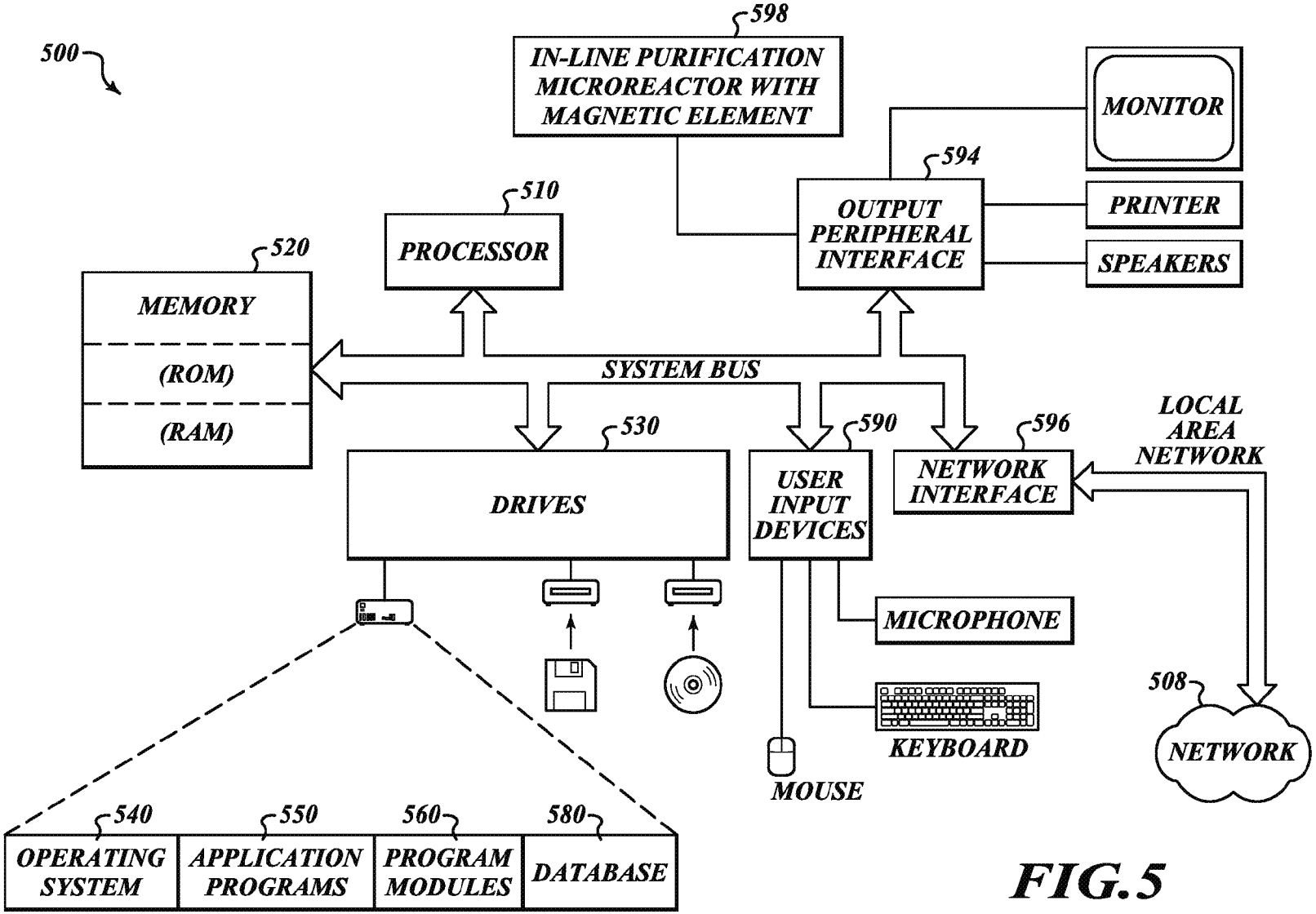
FIG. 5 illustrates a block diagram illustrating an example computing system.

FIG. 5 illustrates a block diagram illustrating an example computing system. FIG. 5 includes a computer 500, including a processor 510, memory 520 and one or more drives 530. The drives 530, and their associated computer storage media, provide storage of computer-readable instructions, data structures, program modules and other data for the computer 500. Drives 530 can include an operating system 540, application programs 550, program modules 560, and database 580. Computer 500 further includes user input devices 590 through which a user may enter commands and data. Input devices can include an electronic digitizer, a microphone, a keyboard and pointing device, commonly referred to as a mouse, trackball or touch pad. Other input devices may include a joystick, game pad, satellite dish, scanner, or the like.

These and other input devices can be connected to processor 510 through a user input interface that is coupled to a system bus, but which may be connected by other interface and bus structures, such as a parallel port, game port or a universal serial bus (USB). Computers such as computer 500 may also include other peripheral output devices such as speakers, printer, or monitor, which may be connected through an output peripheral interface 594 or the like.

Computer 500 may operate in a networked environment using logical connections to one or more computers, such as a remote computer connected to network interface 596. The remote computer may be a personal computer, a server, a router, a network PC, a peer device or other common network node, and can include many or all of the elements described above relative to computer 500. Networking environments are commonplace in offices, enterprise-wide area networks (WAN), local area networks (LAN), intranets and the Internet. For example, computer 500 may comprise the source machine from which data is being migrated, and the remote computer may comprise the destination machine or vice versa. Note however, that source and destination machines need not be connected by a network 508 or any other means, but instead, data may be migrated via any media capable of being written by the source platform and read by the destination platform or platforms. When used in a LAN or WLAN networking environment, computer 500 is connected to the LAN through a network interface 596 or an adapter. When used in a WAN networking environment, computer 500 typically includes a modem or other means for establishing communications over the WAN, such as the Internet or network 508. It will be appreciated that other means of establishing a communications link between the computers may be used.

Additionally, computer 500 may also be connected to in-line purification microreactor with magnetic element 598, such as for example an in-line purification microreactor. One or more of operating system 540, application programs 550, program modules 560, and/or database 580 may include programming instructions or code configured to be executed on processor 510 and which, upon execution by processor 510, may cause computer 500 to transmit signals in-line purification microreactor with magnetic element 598 to operate in-line purification microreactor with magnetic element 598 to perform reactions according to one or more embodiments described herein.

For example, computer 500 may be configured to transmit signals to operate in-line purification microreactor with magnetic element 598 to flow a first fluid through a first channel of in-line purification microreactor with magnetic element 598, wherein the first fluid includes a plurality of first surfactant molecules. Computer 500 may be configured to transmit signals to operate in-line purification microreactor with magnetic element 598 to combine the first fluid with a second fluid from a second channel of in-line purification microreactor with magnetic element 598 to form a mixture in a mixing area of in-line purification microreactor with magnetic element 598, wherein the mixing area is situated at an intersection of the first channel and the second channel. The second fluid may comprise magnetic particles coated with a plurality of second surfactant molecules, and the first surfactant molecules may be attractive to the second surfactant molecules. Computer 500 may be configured to transmit signals to operate in-line purification microreactor with magnetic element 598 to pass the mixture through a third channel coupled to the mixing area to separate the first surfactant molecules from the mixture, wherein the third channel comprises a magnetic channel section.

FIG. 6 illustrates a computer program product. Computer program product 601 may comprise signal-bearing medium 603. Computing program product 601 may be, for example, a compact disk (CD), random-access memory (RAM) such as dynamic random access memory (DRAM) or static random access memory (SRAM), flash memory, a digital versatile disk (DVD), a solid-state drive, a hard disk drive, other optical storage, magnetic cassettes, magnetic tape, magnetic disk storage or other magnetic storage devices, or any other article having a non-transitory signal-bearing medium. Embodiments are not limited to any type or types of computing program products. Signal-bearing medium 603 may contain one or more instructions 605. Embodiments may have some or all of the instructions depicted in FIG. 6. Embodiments of computing program product 601 may have other instructions in accordance with embodiments described within this disclosure. Such instructions, upon execution by a computing device coupled to a microreactor having a plurality of electrokinetic pumps, may cause the computing device to generate signals to operate the microreactor to perform various reactions. For example, instructions 605 may, upon execution by a processor, cause the computing device to generate signals to operate a microreactor to: flow a first fluid through a first channel of the microreactor; combine a first fluid with a second fluid from a second channel of the microreactor to form a mixture in a mixing area of the microreactor; pass a mixture through a third channel coupled to a mixing area, wherein the third channel comprises a magnetic channel section; selectively activate an agitator of the microreactor; and selectively activate one or more wire coils situated proximally to a magnetic channel section to generate a magnetic field.

One example of a pairing of a ferrofluid with a surfactant for use in various configurations is a ferroflouid created by coating a magnetic particle with tetra-methylammonium hydroxide paired with an alkyl benzene sulphonate derivative. In this example, the positively charged ferrofluid is attracted to the negatively charged alkyl benzene sulphonate derivative.

Another example of a pairing of a ferrofluid with a surfactant for use in various configurations is a ferrofluid created by coating a magnetic particle with tetra-methylammonium hydroxide paired with an alpha olefin sulphonate. In this example, the positively charged ferrofluid is attracted to the negatively charged alpha olefin sulphonate.

Another example of a pairing of a ferrofluid with a surfactant for use in various configurations is an oil-based ferrofluid formed by coating magnetic particles with cis-oleic acid paired with dodecyltrimethylammonium bromide (DTAB). In this example, the negatively charged ferrofluid is attracted to the positively charged DTAB.

The herein described subject matter sometimes illustrates different components or elements contained within, or connected with, different other components or elements. It is to be understood that such depicted architectures are merely examples, and, in fact, many other architectures may be implemented that achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated may also be viewed as being "operably connected", or "operably coupled", to each other to achieve the desired functionality, and any two components capable of being so associated may also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

Various operations may be described as multiple discrete operations in turn, in a manner that may be helpful in understanding embodiments; however, the order of description should not be construed to imply that these operations are order-dependent. Also, embodiments may have fewer operations than described. A description of multiple discrete operations should not be construed to imply that all operations are necessary. Also, embodiments may have fewer operations than described. A description of multiple discrete operations should not be construed to imply that all operations are necessary.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments shown and described without departing from the scope of the disclosure. Those with skill in the art will readily appreciate that embodiments of the disclosure may be implemented in a very wide variety of ways. This disclosure is intended to cover any adaptations or variations of the embodiments discussed herein. Therefore, it is manifestly intended that embodiments of the disclosure be limited only by the claims and the equivalents thereof.

What is claimed is:

1. A method for in-line purification, the method comprising:

providing a first fluid having a plurality of first surfactant molecules;

providing a second fluid comprising magnetic particles coated with a plurality of second surfactant molecules selected to bind with the plurality of first surfactant molecules;

contacting the first fluid and the second fluid to form a mixture containing the magnetic particles coated with bound surfactant particles; and passing the mixture through a magnetic field to separate the magnetic particles coated with bound surfactant particles from the mixture, thereby forming a purified mixture comprising the first fluid with the plurality of first surfactant molecules removed.

2. The method of claim 1, wherein the first fluid is an emulsion.

3. The method of claim 2, wherein the emulsion is latex.

4. The method of claim 1, wherein the first fluid is a polymer microemulsion including micelles formed by the first surfactant molecules.

5. The method of claim 4, wherein the micelles comprise polymer particles having the plurality of first surfactant molecules bound to the polymer particles at a boundary between the polymer particles and the first fluid.

6. The method of claim 1, wherein providing the first fluid comprises:

providing a plurality of monomer particles having the plurality of first surfactant molecules bound to the plurality of monomer particles at a boundary between the plurality of monomer particles and the first fluid; and performing a polymerization reaction of the plurality of monomer particles to form micelles comprising polymer particles having the plurality of first surfactant molecules bound to the polymer particles at a boundary between the polymer particles and the first fluid.

7. The method of claim 1, wherein the second fluid is a ferrofluid.

8. The method of claim 7, wherein the ferrofluid comprises about 5% magnetic solid by mass and about 10% of the second surfactant by mass.

9. The method of claim 7, wherein the ferrofluid comprises about 10% of the second surfactant by mass.

10. The method of claim 1, wherein passing the mixture through the magnetic field comprises passing the mixture through a channel including one or more wire coils coupled to a selectable voltage source, and wherein the method further comprises selecting a voltage with the selectable voltage source to generate the magnetic field to separate the magnetic particles coated with bound surfactant particles from the mixture.

11. The method of claim 1, wherein the second surfactant is at least one of: cis-oleic acid, citric acid, and soy lecithin.

12. The method of claim 1, wherein the first surfactant is at least one of: a fatty acid, sodium lauryl sulfate, alpha olefin sulfonate, and derivates thereof.

13. The method of claim 1, wherein the first surfactant is at least one of: alkyl benzene sulphonate, alpha olefin sulphonate, alcohol sulphate, alcohol ethoxy sulphate, alkylphenol ethoxy sulphate, naphthalene sulphonate, a sulphosuccinate, a phosphate ester, alkylphenol alkoxylate, alcohol alkoxylate, alkyl polysaccharide, alkylamine ethoxylate, dodecyltrimethylammonium bromide, hexadecyltrimethylammonium bromide, and derivatives thereof.

14. The method of claim 1, wherein the first surfactant is an alkyl benzene sulphonate derivative and the second surfactant is tetra-methylammonium hydroxide.

15. The method of claim 1, wherein the first surfactant is alpha olefin sulphonate and the second surfactant is tetramethylammonium hydroxide.

16. The method of claim 1, wherein the first surfactant is dodecyltrimethylammonium bromide and the second surfactant is cis-oleic acid.

* * * * *